US005636648A

United States Patent [19]

O'Brien et al.

[11] Patent Number: 5,636,648

[45] Date of Patent: Jun. 10, 1997

[54] MOBILE ROTATOR JET SEWER CLEANER

[76] Inventors: J. T. O'Brien, 1702 Delogier Dr., Glenview, Ill. 60025; Daniel J. O'Brien, 2304 22nd Ave., Sterling, Ill. 61081

[21] Appl. No.: 452,970

[22] Filed: May 30, 1995

[51] Int. Cl.[6] ..... B08B 9/02

[52] U.S. Cl. ..... 134/107; 134/167 C; 239/197; 254/134.3 FT; 254/323; 254/332

[58] Field of Search ..... 134/167 C, 168 C, 134/105, 107; 15/104.33, 315; 254/323, 325, 326, 327, 329, 332, 134.3 R, 134.3 FT; 239/175, 195, 197

[56] References Cited

U.S. PATENT DOCUMENTS

| | | | |
|---|---|---|---|
| 2,766,966 | 10/1956 | Roessler | 254/326 |
| 3,027,141 | 3/1962 | Ellis | 254/323 |
| 3,658,589 | 4/1972 | Shaddock | 134/168 C X |
| 3,829,064 | 8/1974 | Jackson | 254/323 |
| 4,199,837 | 4/1980 | Fisco, Jr. | 134/168 C X |
| 4,650,163 | 3/1987 | Peterson | 254/327 |
| 4,838,302 | 6/1989 | Prange | 137/355.12 |
| 4,896,686 | 1/1990 | Schmidt, Jr. et al. | 134/167 C |

*Primary Examiner*—Philip R. Coe

*Attorney, Agent, or Firm*—Faier & Faier; Martin Faier

[57] ABSTRACT

A mobile rotator jet sewer cleaner vehicle for cleaning a sewer line by fluid pressure, the vehicle having a fluid supply for delivering the fluid under pressure to a hose wound on a reel assembly which can be selectively wound or unwound in a vertical direction, wherein a bearing assembly movable in a horizontal direction is secured on a platform and a reel assembly is mounted on and movable with the bearing assembly. A control for selectively actuating winding and unwinding the hose on the reel assembly is provided, and this control, which may also include other instruments and controls for operating the sewer cleaner, is movable with the bearing and reel assembly. In another embodiment of the invention, the platform telescopes into and away from a recess in the vehicle chassis, so that the reel and bearing assemblies are extended from the vehicle when in use, but may be retracted into the recess when desired, and in such event the retracted jet sewer cleaner may be enclosed within the vehicle.

19 Claims, 7 Drawing Sheets

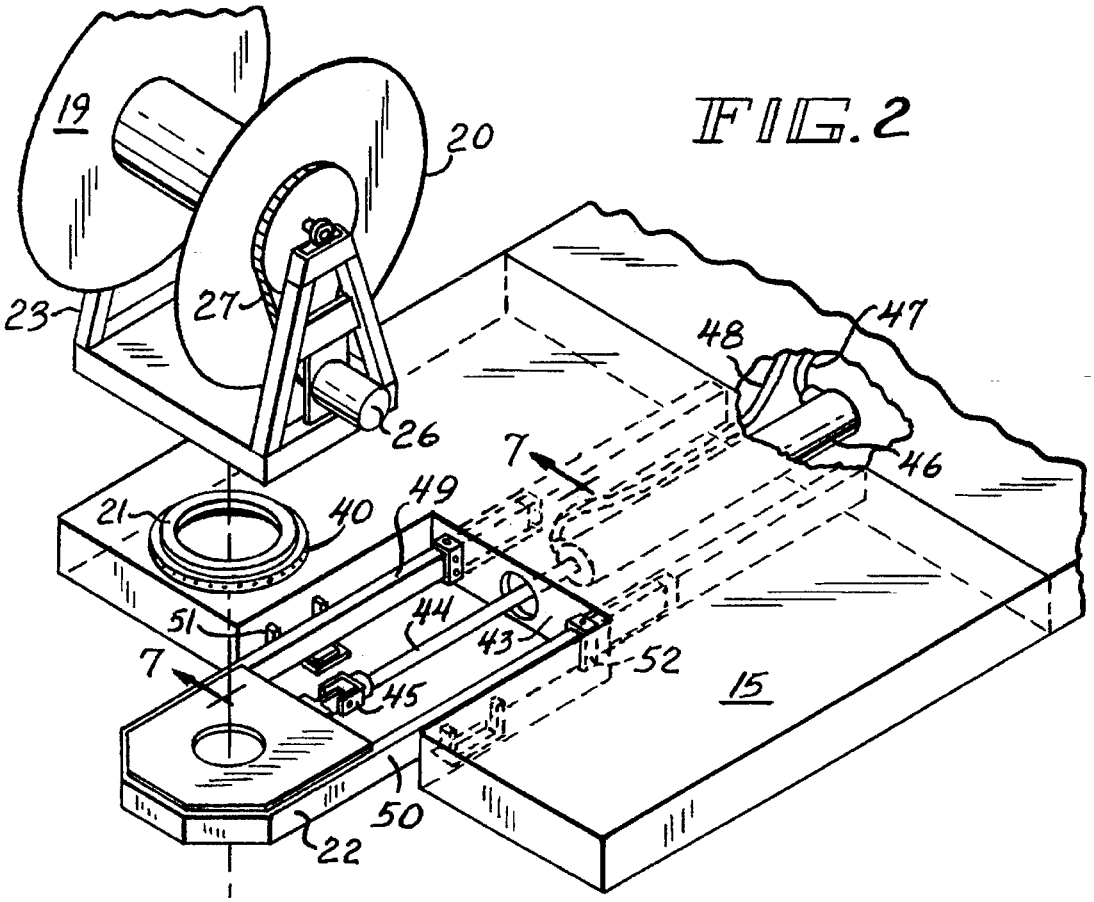
FIG. 2
FIG. 3
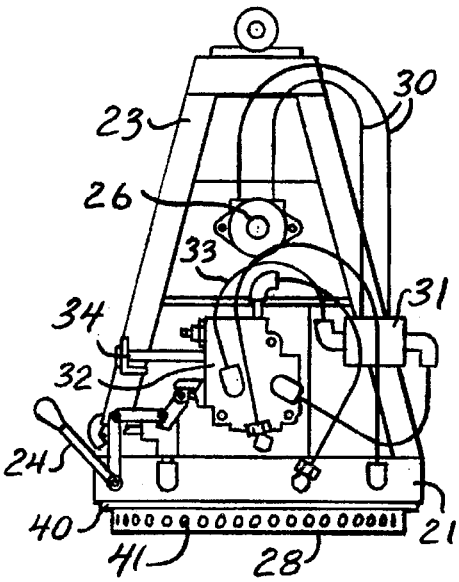
FIG. 4
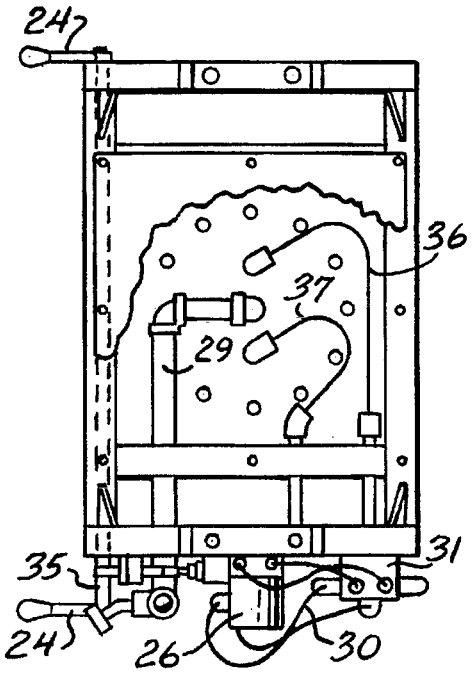

FIG. 5
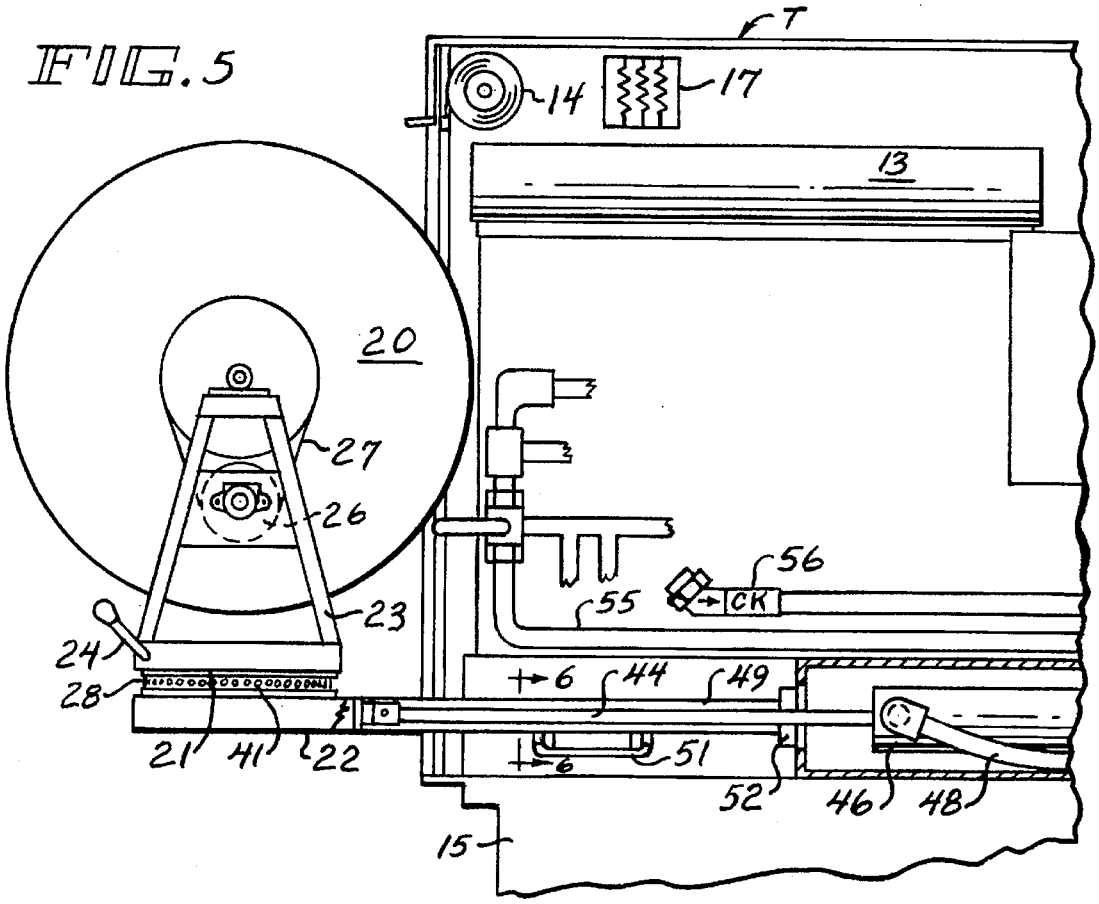
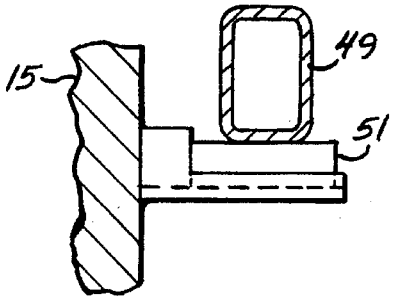
FIG. 6
FIG. 7
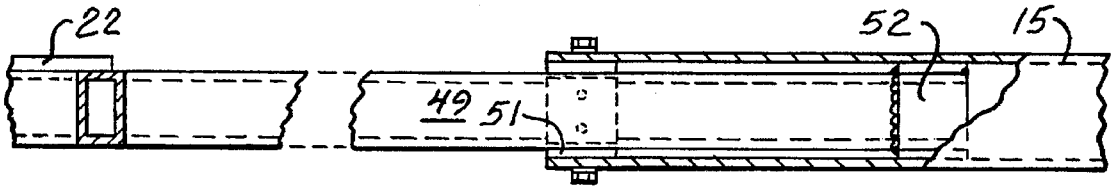

FIG. 10
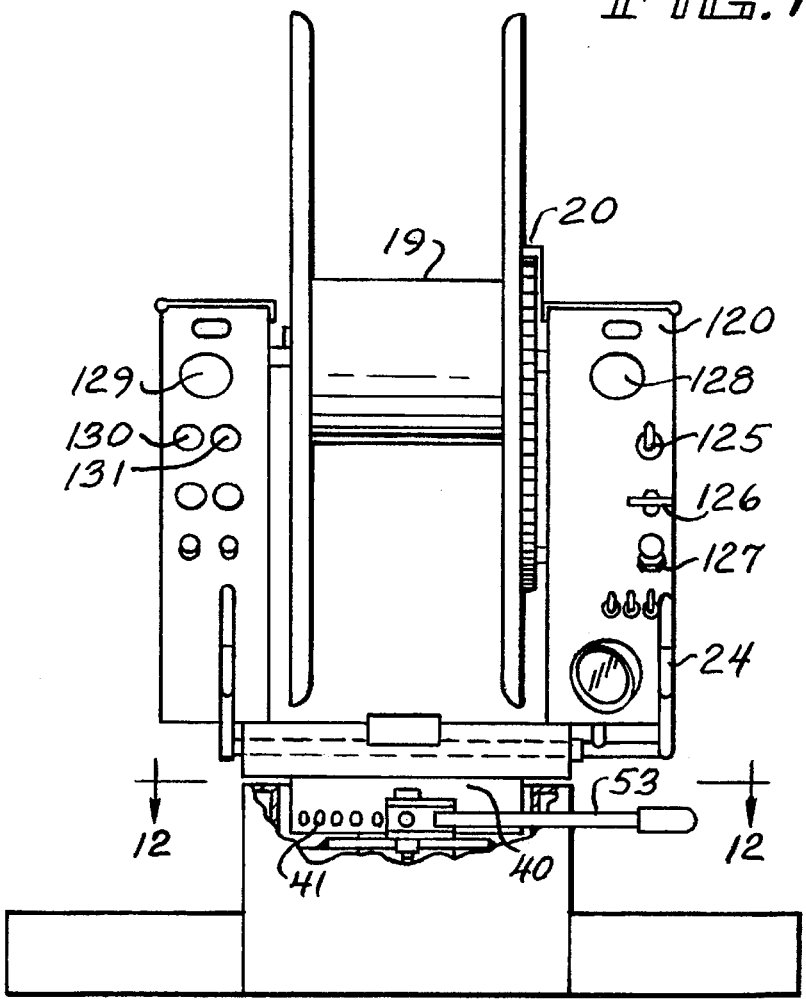
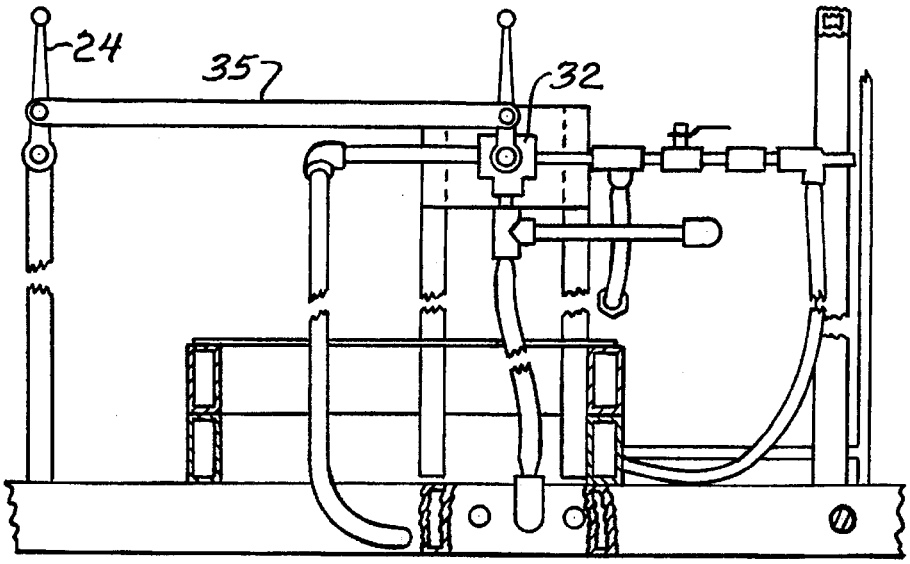
FIG. 11

FIG. 16
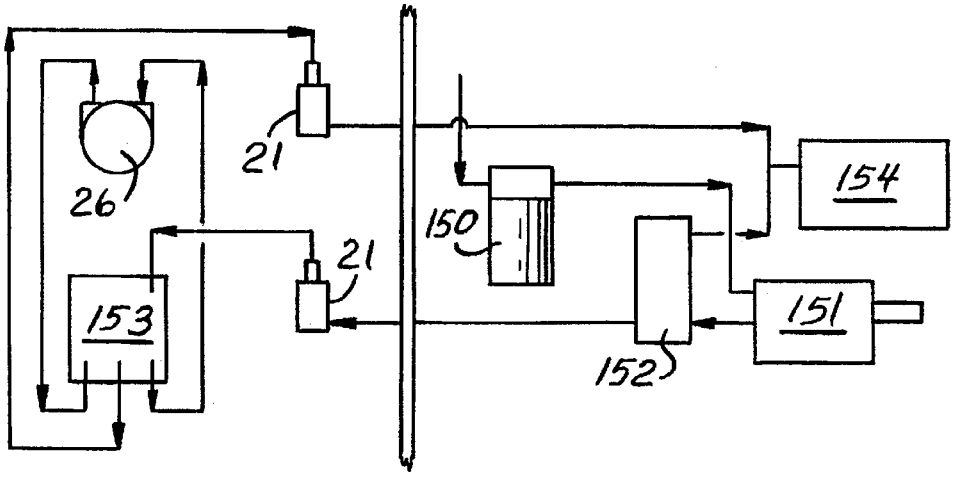
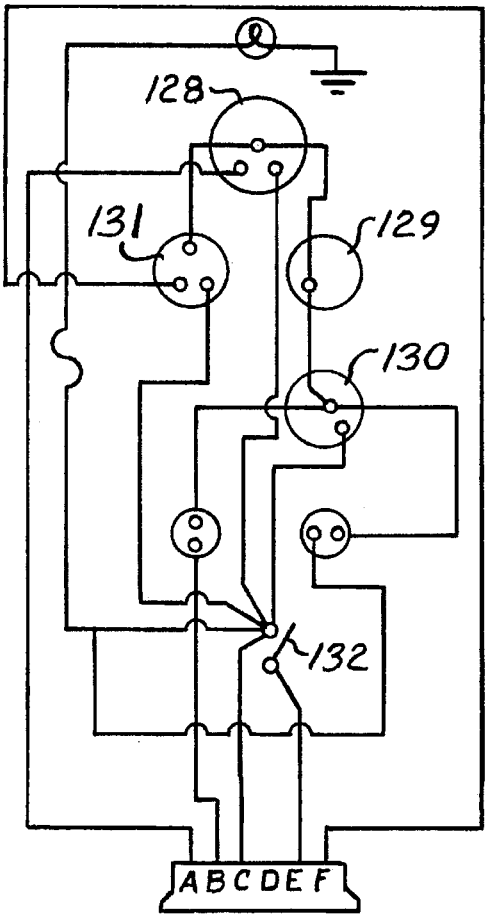
FIG. 17

MOBILE ROTATOR JET SEWER CLEANER

BACKGROUND OF THE INVENTION

This invention relates to mobile sewer cleaning vehicles, such as a truck or trailer, which include a hose for delivering a jet stream of fluid, such as water, under high pressure. More specifically, the invention relates to the construction of such vehicles which utilize high pressure hoses for cleaning sewers and sanitary basins. Such a hose is conventionally wound on a reel which is unwound to reach an area to be cleaned and rewound for transport and storage. A description of the background and prior art for the present invention is shown in U.S. Pat. No. 4,669,145.

SUMMARY OF THE INVENTION

The present invention deals specifically with the manner in which the hose on a reel is presented to the sewer line to be cleaned and the manner in which the reel is articulated for its most convenient and effective safe entry into and through the sewer line, and also deals with the placement and availability of controls for managing the position of the hose, winding and unwinding the hose on its reel, delivery of fluid under pressure and other control features.

These novel features offer safety and convenience not available in known conventional sewer cleaning equipment. By use of a device embodying the present invention, an operator may rotate the reel to deliver the jet hose into a manhole in a straight line from any location near the work zone, without having to park directly over the manhole, thus minimizing the need to work or back up in traffic. Wear and tear on hoses is also reduced, because the operator may avoid steep or excess angles or other obstacles which may injure or snag the hose. Avoiding the effects of hose strain, wear and breaks also result in fewer situations where the hose will break under pressure, injuring persons and equipment in its way.

By providing and securing the novel hose reel on a novel frame which is revolvable on a novel bearing assembly embodying the present invention, the benefits indicated in this application are achieved. Controls may likewise be secured on this novel frame—bearing assembly, so that an operator may manipulate the controls while delivering the hose from the reel into the sewer line.

In such preferred embodiments of the invention, the high pressure hose and its reel is mounted on the novel rotating revolving reel frame assembly movably secured on the novel bearing assembly to articulate the reel into a selected position permitting the delivery of the hose lined up with the sewer line. In a related preferred embodiment, the frame—bearing assembly is secured on a telescopic platform, permitting the assembly to move toward and away from the vehicle frame and when not in use the reel, which when in use is telescopically extended beyond the end of the vehicle, can be retracted to a position inside the vehicle end, permitting the reel frame—bearing assembly to be enclosed within the vehicle by means of a rolling door.

OBJECTS OF THE INVENTION

It is the object of the invention to provide a mobile rotator jet sewer cleaner vehicle of the character recited.

It is also a principal object of the present invention to provide a hose reel assembly for a sewer cleaner vehicle which is capable of rotation on a bearing to a point satisfactory to the operator in line with a sewer line.

Another object is to provide a hose and reel assembly which may be situated beyond the perimeter of the vehicle on which it is mounted and which may be selectively articulated relative to a sewer line.

Another object is to be provide a hose and reel assembly secured on a novel platform and bearing assembly which may be telescopically moved into a closed vehicle and out of the vehicle when utilized to clean a sewer.

Another object is to provide a hose and reel assembly mounted on a novel platform and bearing assembly which carries controls for cleaning a sewer, allowing one person to control delivery of fluid and rotation of the hose on the reel from a selected position, while viewing entry of the hose into a sewer line.

Another object is to provide a fluid jet sewer cleaner hose and reel assembly, which may be selectively wound and unwound, mounted on a novel platform and bearing assembly which may be articulated and locked in a selected position.

Another object of the invention is to provide a mobile rotator jet sewer cleaner vehicle which is simple, easy, efficient, safe and convenient to use under most task situations.

These and other objects and advantages will become apparent as this description proceeds, taken in conjunction with the accompanying drawing.

BRIEF DESCRIPTION OF THE DRAWINGS

In the drawings:

FIG. 2 is an isometric view of the telescoping platform for the truck shown in FIG. 1, showing the hose reel and bearing assembly on the platform.

FIG. 3 is a side view in schematic format showing the reel bearing and frame assembly (but omitting the reel), including the hydraulic system for controlling rotation of the hose reel.

FIG. 4 is a top view of the reel bearing and frame assembly, including the hydraulic system, of the embodiment shown in FIG. 3, with parts broken away.

FIG. 5 is a schematic cut away right side view of the truck and its telescoping platform fully extended with the reel and bearing assembly mounted thereon, with parts broken away.

FIG. 6 is a section detail view of part of the extension bar for the telescoping platform fully extended on which the reel and bearing assembly is mounted, taken on line 6—6 of FIG. 5.

FIG. 7 is a detailed section view taken along line 7—7 of FIG. 2, showing the telescoping beams for the platform which carries the rotatable reel and hose assembly.

FIG. 10 is a elevational view, with part of the bearing broken away, of the hose reel and bearing assembly shown in FIG. 9.

FIG. 11 is a view of the reel bearing assembly taken on line 11—11 of FIG. 9.

FIG. 16 is a schematic view of part of a typical hydraulic system for a trailer embodiment shown in FIG. 10.

FIG. 17 is a schematic view of a panel for the control system.

DETAILED DESCRIPTION OF THE PREFERRED EMBODIMENTS

Figure 1:
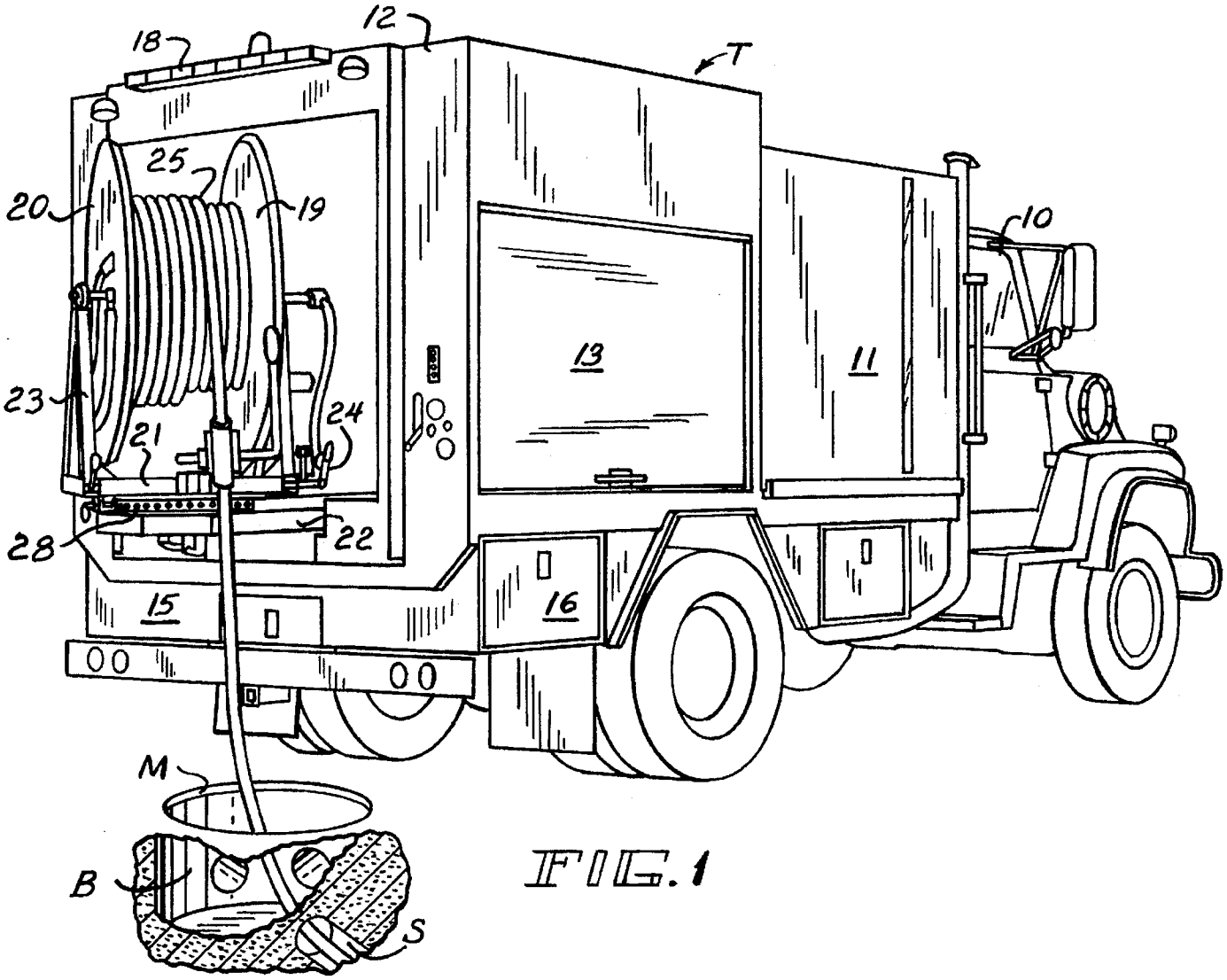
FIG. 1 is a perspective view of a preferred sewer cleaner vehicle embodying the present invention in operable position, which in this embodiment comprises a truck.

In FIGS. 1–7, the mobile sewer cleaner vehicle embodying the invention comprises a truck T, and in FIGS. 8–17, the vehicle embodying the invention comprises a trailer R. Novel features shown in the truck environment can be utilized on a trailer and novel features shown in the trailer environment can be utilized on a truck, without departing from the scope or spirit of the invention. Either vehicle may be used for cleaning a sewer line by means of a rotator jet arranged on a hose windable on a reel which rotates on a bearing assembly.

As shown in the truck embodiment depicted in FIGS. 1–7, the truck, which has a driver's cab 10, a hold 11 for storing water or other fluid, and a frame 12 which is closed by one or more side doors 13 and a rear door 14, which may be of roll-up style, and is mounted on a truck chassis 15. There may be a container 16 for storing tools secured to the chassis 15, and a heater device 17 may be mounted within the closeable part of the frame 12; hazard lights 18 may be mounted on the frame for warning the public when the truck is servicing a sewer.

The truck embodying the present invention has a hose reel 19 arranged in a reel assembly 20 windable in a vertical direction which is secured for horizontal rotation on a bearing assembly 21 which is mounted on a telescoping platform 22, and the hose reel assembly is arranged in a frame 23, which may be extended beyond the end of the truck T, so that its hose 25 can be wound or unwound on the reel 19 and fed into a sewer tunnel or line S extending from a bell B in a manhole M in straight line relationship between the hose and the sewer tunnel. Winding and unwinding of the hose 25 in a vertical direction on the reel assembly 20 may be accomplished by use of a motor 26, preferably hydraulic. The reel assembly 20 may also be articulated in a horizontal direction on the bearing assembly 21, which has a plurality of ratchet members 28 for locking the reel assembly in a selected position, preferably in line with the manhole M and sewer line S.

With reference to FIGS. 2 and 3, mounted on the reel frame 23 is the hydraulic motor 26 which drives a chain 27 for turning the reel 19 in the reel assembly 20 in a selected direction to wind or unwind hose 25 arranged on the reel. This motor 26 can be selectively run in either forward or reverse direction, depending upon the direction of movement of the hydraulic fluid, and is fed by hydraulic lines 30 which are connected to a brake valve 31 which is actuated by fluid passing through control valve 32 having fluid intake and outlet hoses 33 connected to the valve 31. The speed of winding or unwinding of the reel 19 is controlled by hydraulic speed adjustment device 34, and the direction of hydraulic fluid movement is controlled by adjuster mechanism 35 linked on opposed sides to the control valve 32.

As shown in FIG. 4, the reel frame 23 also carries hydraulic fluid lines 36 and 37. High pressure intake line 29 is controlled by the adjuster mechanism 35 for which its control handles 24 linked on both the right and left side of the frame 23 can be seen, so that an operator can control winding or unwinding of the hose 25 on the reel assembly 20 from either side of the reel 19.

The reel frame 23 is secured on the bearing assembly 21 which is horizontally rotatably secured to the platform 22, which is carried by the chassis 15 of the vehicle. This bearing assembly 21 preferably has a ring 40 about which are spaced a series of apertures 41 and a reel rotation lock subassembly 42 of the kind shown in FIG. 13 may be used to lock the reel in a selected position, preferably with the hose 25 arranged in line with the sewer line S to be cleaned.

As best shown in FIG. 2 and 5, this reel assembly 20 and bearing assembly 21 may be mounted on a telescoping platform 22, which is intended to move the reel assembly 20 and bearing assembly 21 into a recess 43 formed in the chassis 15 permitting the reel and bearing assemblies to be retracted into the confines of the vehicle frame 12 for storage and transportation and to be extended from the vehicle chassis 15 when in use. When the platform 22 is retracted, the vehicle frame 12 may be closed by the doors 13 and 14 and the on-board heater 17 may be used to melt any ice which has formed in the hose 25, eliminating the danger of ice being forced from the hose under pressure when placed into use in colder climates.

This platform 22 is connected to a central ram 44 by means of a yoke 45 at one end of the ram and the other end of the ram is secured in a hydraulic piston cylinder assembly 46, for which fluid is provided by means of an inlet pipe 47 and outlet pipe 48 connected to a hydraulic motor or take-off (not shown) which drives the ram 44 toward and away from the end of the chassis 15, to extend or retract the platform. This platform 22 also has a pair of opposed beams 49 and 50 each of which at one end rides over support member 51 formed in the chassis 15 and at the other end in the rear of the recess 43 are supported by tubular supports 52 secured in the chassis.

Details of this structure for supporting the platform 22 by means of the beams 49–50 and support members 51, together with the tubular supports 52 secured in the chassis 15 is schematically shown in FIG. 2, with details shown in FIG. 5 and 6. FIG. 7, taken on line 7—7 of FIG. 2, also shows details of the platform 22 supported by the beans 49 over supports 51 through tubular supports 52 nested in the recess 43 of the chassis 15.

Fluid, such as water under pressure, is delivered to the hose reel assembly 20 by means of conventional piping connecting the fluid hold 11 and the hose 25, which may also including conventional check valve 56 and similar conventional fluid delivery and pumping mechanism (not shown).

Figure 8:
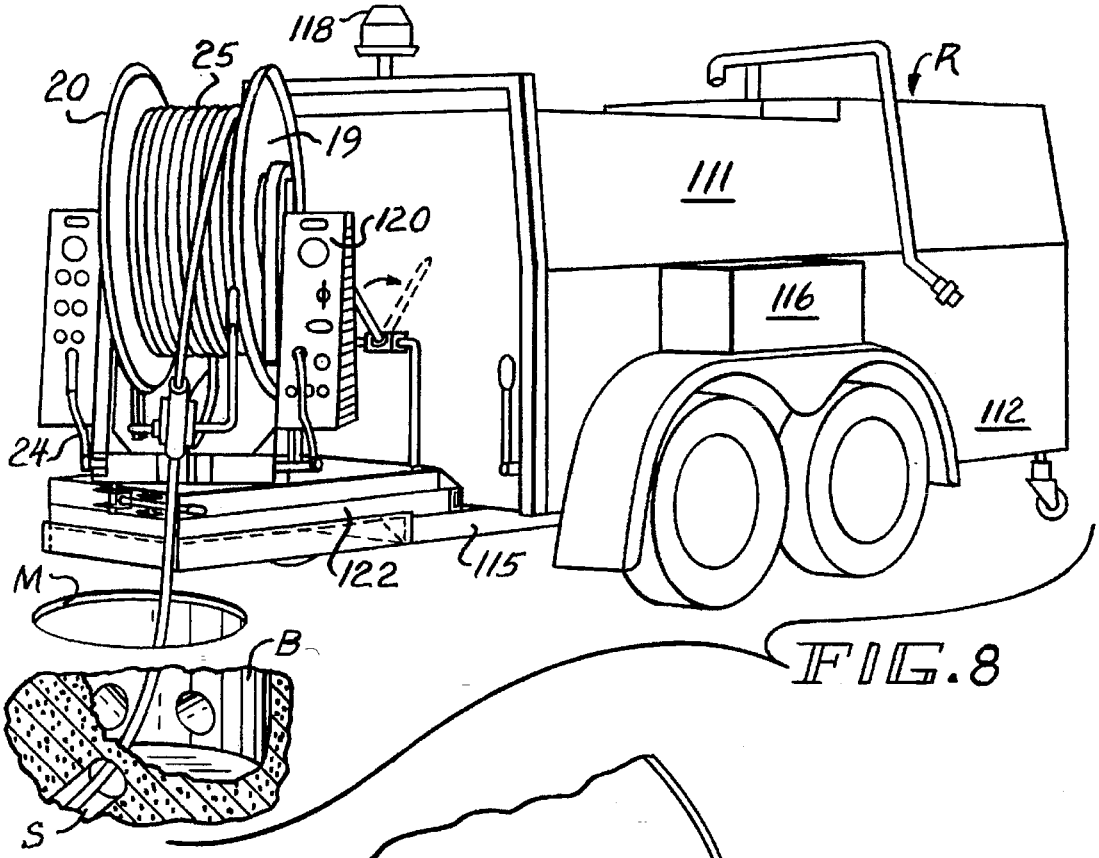
FIG. 8 is a perspective view of another preferred sewer cleaner vehicle embodying the present invention in operable position, which in this embodiment comprises a trailer.

With reference to the trailer type mobile rotator jet sewer cleaner shown in FIGS. 8–17, the trailer R has a water hold 111 contained within a closed truck frame 112 and the frame may carry a tool container 116. A hazard light 118 may be mounted on the trailer, too. As shown in FIG. 8, this embodiment also can be manipulated so that the reel assembly 20 and hose 25 are in line with the sewer line S to be cleaned, entering a manhole M through a bell B in a manner similar to that described with reference to FIGS. 1–7.

In this embodiment of the invention, a hose reel assembly 20 is carried by a articulatable bearing assembly 21, but, as compared with the truck embodiment, the platform 122 may be fixed and secured to the trailer chassis 115. The reel frame 123 shown in this embodiment has one or more extensive control panels 124, to be described hereafter.

A hose 25 is mounted on the reel assembly 20 for winding and unwinding and driven by a motor 26, preferably hydraulic, so that it may operate in selectively reversible directions. Preferably, the bearing assembly 21 has bearing ratchets members 28 spaced about its periphery. Preferably, the reel 19 of the reel assembly 20 is rotated in a vertical direction by means of a chain 27 connecting the motor 26 and the reel 19. The motor 26 is actuated by hydraulic fluid delivered through lines, valve and mechanism in the same manner as described with reference to the truck embodiment shown in FIGS. 1–7.

Figure 12:
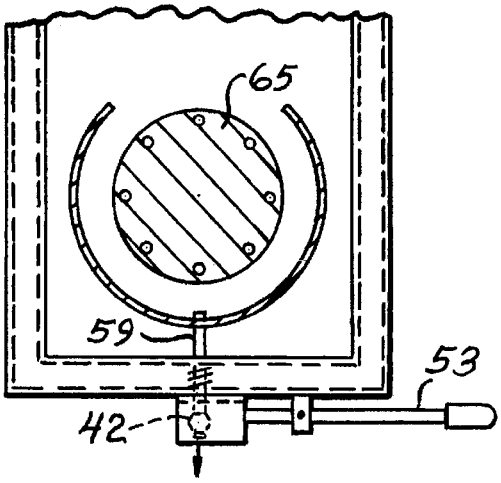
FIG. 12 is a section view of the bearing assembly taken on line 12—12 of FIG. 10.
Figure 13:
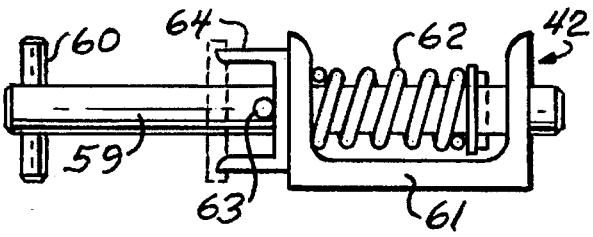
FIG. 13 is an enlarged elevational detail view of the reel rotation lock subassembly for positioning the reel and bearing assembly shown in FIG. 9.
Figure 14:
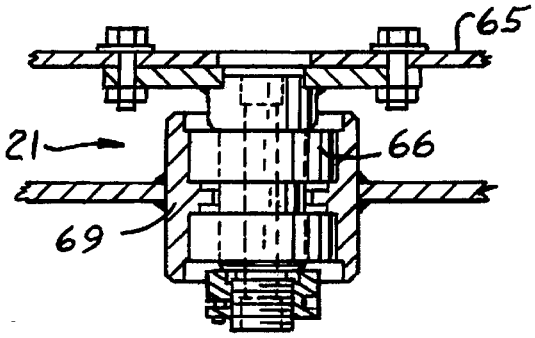
FIG. 14 is a sectional view of the bearing hub for the bearing assembly shown in FIG. 9.

Preferably, bearing assembly 21 comprises a bearing ring 40 which has peripheral apertures 41, and, as shown in FIGS. 12–13, a lock subassembly 42 is adapted to engage within a selected aperture 41, thus lining up the hose reel 20 with manhole M. This lock subassembly 42 comprises a shaft 59, with a cross-pin 60 on one end and a bracket 61 on its other end which is biased by a spring 62 to enter into a selected aperture 41, but which may be withdrawn from the aperture and twisted so that a cooperating second cross-pin 63 may be engaged against a flange 64 to hold the lock subassembly out of an aperture, thus permitting the plate 65 of the bearing assembly 21 to freely turn on its bearing block or hub 66, in the bearing housing 69, shown in FIG. 14. Preferably, the lock subassembly 42 is operated by means of a lock handle 53.

Figure 15:
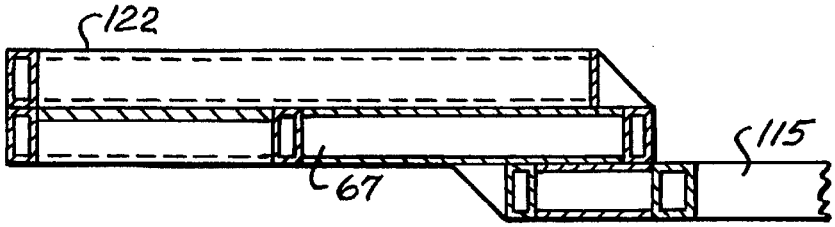
FIG. 15 is detail sectional view of the platform for the hose reel and bearing assembly for the trailer embodiment shown in FIG. 8.

The fixed platform 122 which carries the hose reel assembly 20, bearing assembly 21 and related parts, may comprise a plurality of beams 67 welded together to extend from the trailer chassis 115, as shown in FIG. 15.

Figure 9:
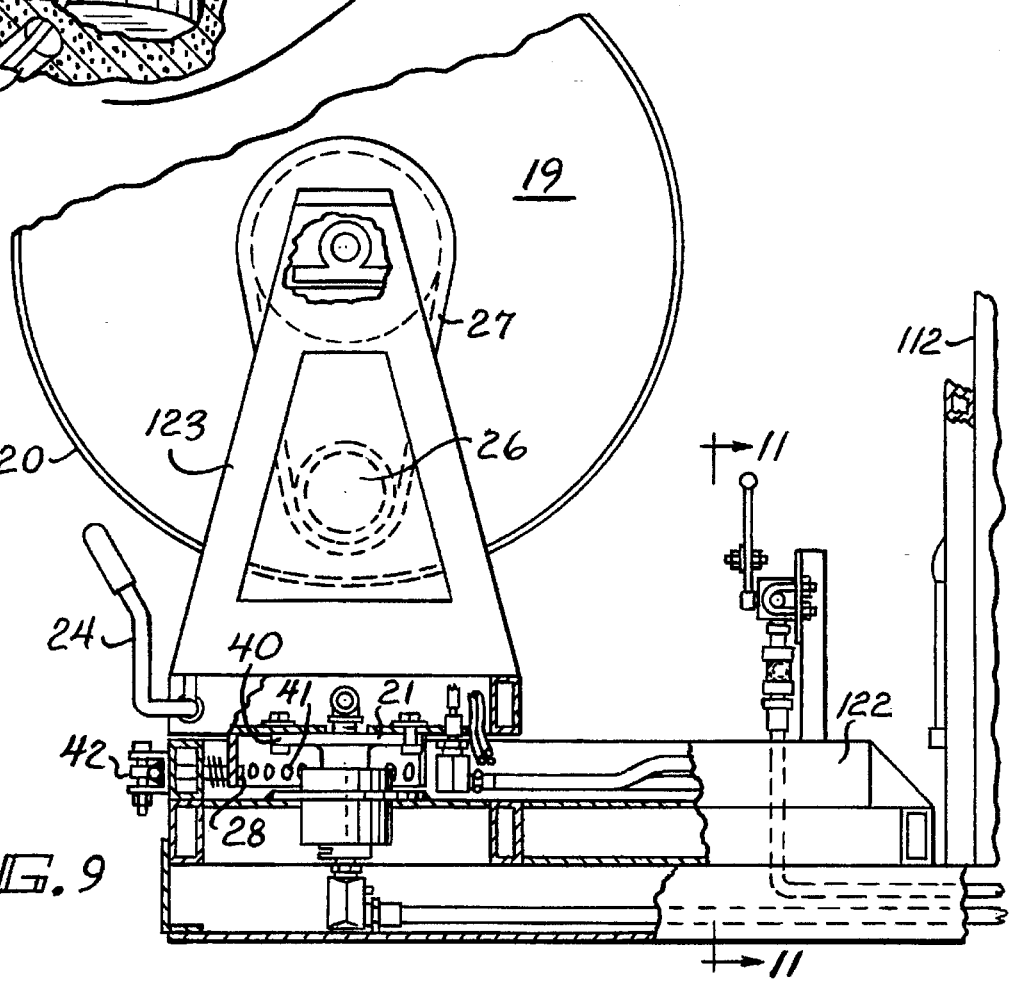
FIG. 9 is a sectional view of the hose reel and bearing assembly for the embodiment shown in FIG. 8.

In the embodiment shown in FIGS. 8–9 and 17, a plurality of instruments and controls are mounted on control panel 120 movable with the reel frame 123, rather than just the controls for the reel 20 as shown in FIG. 1. Here, the reel frame 123 carries not only the handles 68 for the control valve 132, but also such controls and instruments as an ignition switch 125, choke 126, throttle 127, tachometer 128, oil pressure gauge 129, voltmeter 130, water temperature gauge 131, circuit breaker 132, and possibly other devices; and all of these instruments and controls are available to a single operator while the entry and manipulation of the hose into a sewer line is adjusted and controlled.

With reference to the hydraulic system for driving the reel assembly 20 illustrated schematically in FIG. 16, showing a plurality of hydraulic lines connecting various devices, hydraulic fluid enters through a filter 150 where its is circulated by a hydraulic pump 151 through a pressure relief valve 152 into the bearing assembly 21 or rotary swivel mechanism (having opposed ports), which may function to deliver fluid in a selected one of opposed directions, where energy is delivered to a cross valve 153 operating as the reel control valve 32 to actuate the reel drive motor 26, and then fluid is delivered to a tank 154 for reentry into the system. Other piping and valve arrangements may also be provided to accomplish the movement of parts and components forming the invention as described.

While preferred embodiments of the invention have been shown and described in considerable detail, it should be understood that many changes may be made without departing from the scope or spirit of the invention, and it is not desired that the invention should be limited to the exact constructions shown and described.

We claim:

1. In a mobile rotator jet sewer cleaner vehicle for cleaning a sewer line, said vehicle having a fluid supply for delivering fluid under pressure to a hose wound on a reel assembly and adapted to be selectively wound or unwound in a vertical direction, the improvement comprising:

(a) a chassis for said vehicle;

(b) a platform secured on said chassis and selectively movable horizontally toward and away from said vehicle;

(b) means for selectively moving said platform into a first position within the confines of said vehicle and a second position extending from said vehicle, (c) a bearing assembly movable on and secured to said platform adapted for articulation in alignment with said sewer line;

(d) said reel assembly being mounted on and movable with said bearing assembly;

(e) fluid transfer means for delivery of pressurized fluid into said hose from said vehicle fluid supply; and (d) control means for selectively actuating winding and unwinding of said hose on said reel assembly.

2. In the sewer cleaner vehicle recited in claim 1, wherein said reel assembly comprises a frame, a motor and drive means mounted on said frame, and a reel for said hose movably secured for rotation in a vertical direction to said frame and connected to said motor and drive means.

3. In the sewer cleaner vehicle recited in claim 2, wherein hydraulic connections secured to said frame deliver fluid to said motor.

4. In the sewer cleaner vehicle recited in claim 3, wherein said hydraulic connections enter said reel assembly through said bearing assembly.

5. In the sewer cleaner vehicle recited in claim 4, wherein said hydraulic connections are secured to said platform when entering said bearing assembly.

6. In the sewer cleaner vehicle recited in claim 1, wherein said bearing assembly comprises a ring movable with said reel assembly revolvable on said platform in a horizontal direction and stop means for securing said ring in a selected position.

7. In the sewer cleaner vehicle recited in claim 7, wherein said ring has a plurality of apertures spaced about its periphery.

8. In the mobile rotator jet sewer cleaner vehicle recited in claim 1, wherein a control and instrument panel is secured to said reel assembly, said control and instrument panel being horizontally pivotable and movable with said platform.

9. In the mobile rotator jet sewer cleaner vehicle recited in claim 8, wherein said control and instrument panel comprises switches and devices for actuating and indicating the performance of said sewer cleaner.

10. In a mobile rotator jet sewer cleaner vehicle for cleaning a sewer line, said vehicle having a fluid supply for delivering fluid under pressure to a hose wound on a reel assembly and adapted to be selectively wound or unwound in a vertical direction, the improvement comprising:

(a) a chassis for said vehicle;

(b) a platform secured on said chassis and selectively movable horizontally toward and away from said vehicle, said chassis having a recess for said platform;

(b) a piston-cylinder assembly for selectively moving said platform into a first position within the confines of said vehicle and a second position extending from said vehicle;

(c) a bearing assembly movable on and secured to said platform adapted for articulation in alignment with said sewer line:

(d) said reel assembly being mounted on and movable with said bearing assembly; and (d) control means for selectively actuating winding and unwinding said hose on said reel assembly.

11. In the sewer cleaner vehicle recited in claim 10, wherein said windable reel assembly is driven by a hydraulically actuated motor.

12. In the sewer cleaner vehicle recited in claim 11, wherein said hydraulically actuated motor is selectively reversible for driving said reel assembly in opposed directions to selectively wind or unwind said hose responsive to said control means.

13. In the sewer cleaner vehicle recited in claim 11, wherein a speed adjustment device controls the speed at which said hose is wound or unwound on said reel assembly.

14. In the sewer cleaner vehicle recited in claim 13, wherein said speed adjustment device is secured to and movable with said reel assembly.

15. In the mobile rotator jet sewer cleaner vehicle recited in claim 10, wherein said platform has spaced apart beams extending into said recess.

16. In the mobile rotator jet sewer cleaner vehicle recited in claim 15, wherein said chassis has support means for carrying and guiding said platform beams into and away from said recess.

17. In the mobile rotator jet sewer cleaner vehicle recited in claim 10, wherein said vehicle has a closed frame into which said platform may be recessed.

18. In a mobile rotator jet sewer cleaner vehicle for cleaning a sewer line, said vehicle having a fluid supply for delivering fluid under pressure to a hose wound on a reel assembly adapted to be selectively wound or unwound in a vertical direction, the improvement comprising:

(a) said vehicle being normally closed but having a selectively openable door adapted to be opened for sewer cleaning use;

(b) a platform secured in said vehicle selectively movable horizontally to extend outwardly from said vehicle through said door when opened and to retract into said vehicle for permitting said door to be closed;

(c) means for moving said platform into said selectively movable positions, (d) a horizontally movable bearing assembly secured on said platform adapted for articulation in alignment with said sewer line;

(e) said reel assembly being mounted on and movable with said bearing assembly;

(f) fluid transfer means for delivery of pressurized fluid into said hose from said vehicle fluid supply; and (g) control means for selectively actuating winding and unwinding of said hose on said reel assembly.

19. In the mobile rotator jet sewer cleaner vehicle recited in claim 18, wherein said vehicle when closed has heater means.

* * * * *